US005145211A

United States Patent [19]

McKillip

[11] Patent Number: 5,145,211

[45] Date of Patent: Sep. 8, 1992

[54] AIR BAGGAGE TAG

[75] Inventor: Barron G. McKillip, Grand Rapids, Mich.

[73] Assignee: CCL Label, Inc., Grand Rapids, Mich.

[21] Appl. No.: 691,145

[22] Filed: Apr. 25, 1991

[51] Int. Cl.[5] ..... G09F 3/20

[52] U.S. Cl. ..... 283/80; 285/105; 40/6; 40/27

[58] Field of Search ..... 283/80, 105; 40/6, 27, 40/299, 662

[56] References Cited

U.S. PATENT DOCUMENTS 3,228,129 1/1966 Gwinn et al. ..... 283/80

3,648,838 3/1972 Hiromura ..... 283/80

4,631,845 12/1986 Samuel et al. .

4,661,189 4/1987 Voy et al. .

4,951,971 8/1990 Whited .

*Primary Examiner*—Timothy V. Eley

*Assistant Examiner*—Willmon Fridie, Jr.

*Attorney, Agent, or Firm*—Warner, Norcross & Judd

[57] ABSTRACT

A combination baggage tag and claim ticket is disclosed formed as a strip of flexible material having two tongues for encircling the handle of a piece of baggage and a detachable ticket disposed between the tongues. The back surface of the strip is pattern coated with adhesive such that two adhesive-free zones are left on the tongues with adhesive coated bands at the free ends of the tongues.

15 Claims, 1 Drawing Sheet

AIR BAGGAGE TAG

BACKGROUND OF THE INVENTION

1. Field of the Invention

The present invention relates to a baggage tag of the type used by commercial airlines to identify and route baggage.

2. Description of the Related Art

Air baggage tags are known in which a combination tag and claim ticket is formed of a strip of flexible material. As disclosed in U.S. Pat. No. 4,631,845, issued Dec. 30, 1986, which patent is incorporated herein by reference, such a tag may comprise an elongate strip of flexible material with pressure sensitive adhesive applied to the entirety of the back surface of the strip. One end of the strip comprises a body portion having a longitudinal fold line, and the other end has a pair of longitudinal tongues spaced apart on either side of a detachable claim ticket portion. The tag and claim ticket portions of the strip are printed with indicia showing, for example, the name of the airline, the origin and destination airports, and numbers by which the claim ticket may be paired with the tag. The strip is peelably adhered to a release liner. When used, the tag portion of the strip is removed from the liner and the tongues are wrapped or encircled around the handle of a piece of baggage. The body portion is folded against itself along the longitudinal fold line. The adhesive on the back of the tag adheres the tongues together and to the baggage handle, and adheres the body portion to itself. The claim ticket portion, previously detached from the tag portion and removed from the backing, is adhered to the passenger's ticket stub or envelope for subsequent use in retrieving the baggage.

U.S. Pat. No. 4,951,971, issued Aug. 28, 1990, which patent is also incorporated herein by reference, discloses a similar type of baggage tag having pressure sensitive adhesive material applied to the entirety of the rear surface of the flexible strip. Additionally, an adhesive desensitizer, such as a varnish, is applied to the adhesive over a portion of the tongues. The desensitized areas of the tongues do not adhere to the baggage handle so as to prevent transferring adhesive from the tag to the baggage handle. Further disclosed is the use of reinforcing strips on the tongues to prevent tearing.

Therefore, the prior art provides an air baggage tag with a detachable claim ticket initially formed as a flexible strip having pressure sensitive adhesive applied over the entirety of the back surface and, additionally, with adhesive desensitizer applied to the adhesive on portions of the tab tongues. Such a construction is needlessly complicated and uneconomical due to the excess of adhesive used and to the application of desensitizer to portions of the adhesive.

Accordingly, there is an unmet need for an air baggage tag of simple and economical construction using a minimum of adhesive, and which will not unduly adhere to a baggage handle or leave a residue of adhesive on the handle.

SUMMARY OF THE INVENTION

The present invention meets the aforementioned need by providing an air baggage tag formed of flexible strip including a baggage tag portion with tongues straddling a detachable claim ticket wherein pressure sensitive adhesive is applied to the entirety of the back surface of the strip except in adhesive-free zones along the lengths of each tongue. Adhesive coated bands are left at the free ends of the tongues. The adhesive is applied by pattern coating, such as by the use of a screen process.

In a preferred embodiment, the flexible strip is made of a tough, tear-resistant material. Advantageously, the material is a lamination of polypropylene sheet between two layers of paper. No reinforcing strips are required.

These and other objects, advantages, and features of the present invention will be more fully understood and appreciated by reference to the written specification and appended drawings.

DESCRIPTION OF THE PREFERRED EMBODIMENT

Figure 1:
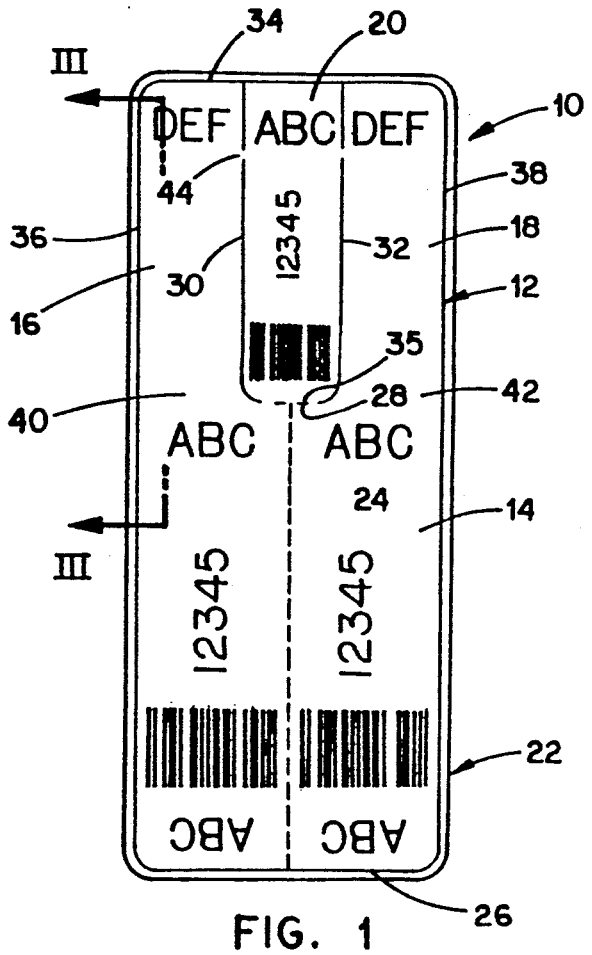
FIG. 1 is a top plan view of an air baggage tag according to the principles of the invention.
Figure 2:
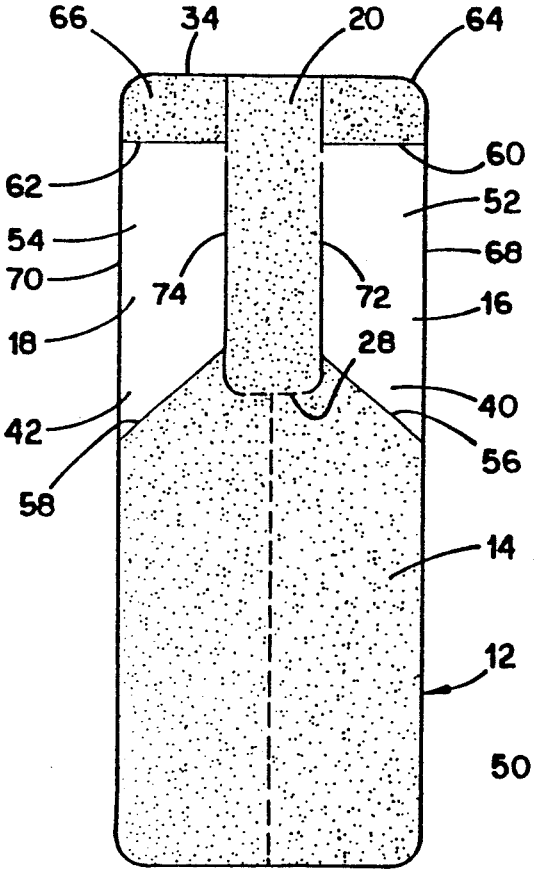
FIG. 2 is a rear view thereof with the release liner removed.

By way of disclosing a preferred embodiment of the invention, and not by way of limitation, there is shown in FIGS. 1 and 2 a baggage tag 10 which includes an elongated strip 12 of flexible material having a tag portion including a body 14 at one end of the strip, two laterally spaced apart tongues 16, 18 extending longitudinally from the body 14 at the other end of the strip, a detachable claim ticket 20 disposed straddled between the two tongues 16, 18 and the body 14, and a release liner 22 releasably adhered to the back of the strip 12.

In known fashion, various indicia are printed on the front of the strip, such as origin and destination airport codes, carrier identifiers, bar codes, and claim ticket identification numbers. The indicia may be printed at the site of manufacture of the ticket, at the place where the baggage is checked in, or at a combination of the two or other locations. Certain of the information is repeated on the tag body 14 and on the claim ticket 20 so that a passenger bearing the ticket may reclaim the baggage. Also, information is repeated on the tag body 14 on either side of longitudinal fold line 24 so that the information will be easily visible when the tag is attached to a baggage handle.

The body 14 of the tag comprises the greater portion of the strip, extending for more than half the length thereof. Fold line 24 extends longitudinally from the first end 26 of the strip to the base 28 of the claim ticket 20 between the bases 40, 42 of the tongues 16, 18. Fold line 24 may be scored, or is preferably formed as an interrupted line of cuts at least partially through the thickness of the strip 12.

The claim ticket 20 is defined by a U-shaped cut line through the thickness of the strip 12 having longitudinally, laterally spaced apart side portions 30, 32 extending from the second end 34 of the strip to the base 28 and a base portion 35 bridging across the side portions coincident with the base 28. The tongues 16, 18 are defined between the cut line side portions 30 32 and the longitudinal side edges 36, 38 of the strip 12. The tongues have base portions 40, 42 on either side of the claim ticket base 28. The cut line comprising portions 30, 32, and 35 may be continuous, or preferably is interrupted by short uncut portions such as at 44 to lessen the possibility of unintended detachment of the claim ticket.

The release liner 22 is slightly larger in outline that the strip 14, and is made of paper having a silicone coating, as is well known in the art. If desired, indicia may be printed on the back of the release liner.

Figure 3:
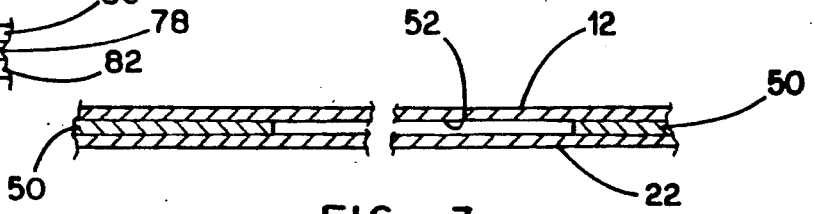
FIG. 3 is a sectional view taken along the line 3—3 of FIG. 1 with thicknesses exaggerated for clarity of illustration.

As shown in FIGS. 2 and 3, substantially the entire back surface of the strip is coated with an adhesive material except for two adhesive-free zones 52, 54. The adhesive-free zones are generally coextensive with the tongues except for portions of the free ends of the tongues. The zones extend laterally across the entire widths of the tongues and longitudinally from boundary lines 56, 58 adjacent the base portions of the tongues to lines 60, 62 which extend across the free ends of the tongues spaced-apart inwardly from the second end 34 of the strip. Thus, the tongues 16, 18 are substantially adhesive-free except for two bands 64, 66 across the free ends of the tongues.

The adhesive material used is preferably a general purpose pressure sensitive permanent adhesive of a type well known in the art. Alternatively, a cohesive material may be used of the type which will adhere only to itself. If a cohesive material is used, the release liner is not necessary. As used herein, the term "adhesive material" is intended to include both adhesive and cohesive materials.

When the tongues 16, 18 are encircled about a baggage handle, the adhesive-free zones 52, 54 prevent unnecessary adhesion of the tongues to the handle and transfer of adhesive material to the handle. The lines 56, 58, which define the base extents of the adhesive-free zones, are preferably formed to slope laterally outwardly and toward the first end of the strip 17. With this arrangement, the outer edges 68, 70 of the adhesive-free zones are longer than the inner edges to provide a greater degree of accommodation for a baggage handle passing between the tongues wrapped therearound while still ensuring that the portions of the tab body 14 adjacent the base 28 are firmly adhered together.

Figure 4:
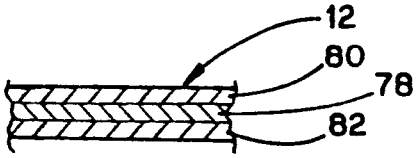
FIG. 4 is an enlarged sectional view through the flexible strip material of the air baggage tag.

Preferably, the strip 12 is made of a tough, tear-resistant material. As shown in FIG. 4, the preferred material is a lamination of an inner layer 78 of 2 mil monoaxially oriented polypropylene between outer layers 80, 82 of 40 pound machine grade kraft paper. A suitable material for the strip 12 is commercially available under the trademark TRITEX.

Figure 5:
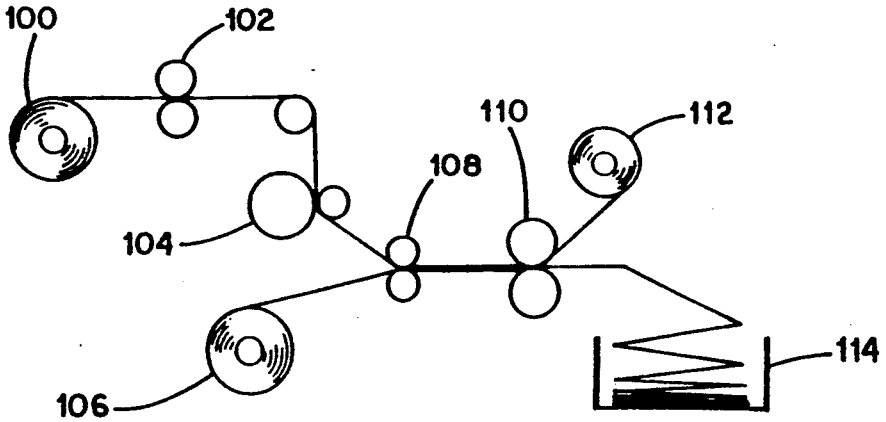
FIG. 5 is a diagrammatic side view illustrating the process and apparatus for manufacturing the air baggage tag according to the invention.

The manufacture of the baggage tag of the invention may be accomplished by a pattern coating method. An exemplary method for manufacturing a continuous web of a plurality of baggage tags is shown in FIG. 5. A continuous web 100 of strip material passes between printing rollers 102 which print desired indicia on the face of the strip. The web then passes to a pattern adhesive coating device 104 which applies adhesive to the back of the web only in the desired areas. The adhesive coating device is a screen printing device such as disclosed in U.S. Pat. No. 4,661,189, issued Apr. 28, 1987, which Patent is incorporated herein by reference.

A continuous web of release liner paper 106 is provided which passes, along with the strip material, between pressure rollers 108, thus adhering the release liner to the back of the strip. The adhered-together webs then pass between die cutting rollers 110 which form the fold lines and lines defining the claim ticket and tongues. The die cutting rollers may also cut along the perimeters of the baggage tags being formed and provide perforated lines in the release liner between adjacent baggage tags.

Excess strip material cut away from the perimeters of the baggage tags is taken up on a waste spool 112. The finished web of baggage tags is fan folded and received in bin 114.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An improved baggage tag of the type including a strip of flexible material having front and back surfaces, first and second longitudinally spaced apart ends and laterally spaced apart sides, a tag body at the first end of the strip adapted to be folded against itself along a longitudinal fold line, a pair of laterally spaced apart tongues extending longitudinally from a base portion thereof adjacent said tag body to the second end of the strip and adapted to encircle the handle of a piece of baggage, and a detachable claim ticket disposed between said tongues, the back surface of said strip being adhesive except in two zones on said tongues, said zones extending from adjacent the base portions of said tongues to positions adjacent to but spaced apart from said second end, wherein the improvement comprises an adhesive material coated on substantially the entirety of the back surface of said strip except in said zones, said zones being uncoated and free of adhesive material.

2. The baggage tag of claim 1 wherein the longitudinal length of each of said zones along the strip sides is greater than the longitudinal length of said zones along the claim ticket.

3. The baggage tag of claim 2 wherein a boundary line is formed between each of said zones and said tag body, each of said boundary lines extending from said claim ticket adjacent said tag body laterally outwardly to one of said sides, said boundary lines sloping toward said first end.

4. The baggage tag of claim 3 wherein said strip material comprises monoaxially oriented polypropylene.

5. The baggage tag of claim 3 wherein said strip material further comprises at least one outer layer of paper material laminated to said tough, tear-resistant material.

6. A baggage tag comprising an elongated strip of material having first and second longitudinally spaced-apart ends and front and back surfaces, a first portion of said strip at said first end comprising a tag body, a second portion of said strip at said second end comprising a pair of longitudinal tongues adapted to encircle the handle of a piece of baggage and thereby attach the baggage tag to the piece of baggage, said tongues extending from a central portion of said strip adjacent said tag body to said second end, and adhesive material coating substantially the entirety of the back surface of said strip except for two zones being uncoated and free of adhesive material, said zones being substantially coextensive with said tongues except for adhesive-coated bands disposed at the free ends of said tongues adjacent said strip second end.

7. The baggage tag of claim 6 wherein said strip further includes a detachable claim ticket.

8. The baggage tag of claim 7 wherein said detachable claim ticket is disposed between said tongues.

9. The baggage tag of claim 6 wherein said strip comprises a layer of tough, tear-resistant material laminated to at least one layer of paper.

10. The baggage tag of claim 9 wherein said layer of tough, tear-resistant material comprises monoaxially oriented polypropylene.

11. A method for manufacturing a baggage tag comprising the steps of:

providing an elongated strip of material;

coating substantially the entire rear surface of said strip with adhesive material except in a pair of longitudinally extending, generally parallel and laterally adjacent zones, said zones remaining uncoated and free of adhesive material, said zones extending toward an end of said strip but spaced apart therefrom;

cutting a line between said zones to form a pair of tongues adapted to encircle the handle of a piece of baggage, said tongues being substantially uncoated and free of adhesive material except for adhesive coated bands across the free ends thereof.

12. The method of claim 11 wherein said step of cutting comprises cutting a U-shaped line so as to form a detachable claim ticket between said tongues.

13. The method of claim 11 further comprising adhering a release liner to the rear surface of said strip.

14. The method of claim 13 wherein said step of coating comprises pattern coating through a screen.

15. The method of claim 11 further wherein a plurality of baggage tags are formed end-to-end along a continuous web of said strip material.

* * * * *